United States Patent [19]

Cassidy

[11] Patent Number: 5,020,717

[45] Date of Patent: Jun. 4, 1991

[54] LOCK SET TRAY

[75] Inventor: Benjamin J. Cassidy, Waldwick, N.J.

[73] Assignee: International Paper Company, Purchase, N.Y.

[21] Appl. No.: 506,143

[22] Filed: Apr. 9, 1990

[51] Int. Cl.[5] ..... B65D 5/30

[52] U.S. Cl. ..... 229/114; 229/195; 229/197

[58] Field of Search ..... 229/114, 195, 197

[56] References Cited

U.S. PATENT DOCUMENTS

| | | | |
|---|---|---|---|
| 199,675 | 1/1878 | Wolf | 229/195 |
| 518,899 | 4/1894 | Schmidt | 229/195 |
| 871,767 | 11/1907 | Raynaud | 229/197 |
| 1,195,539 | 8/1916 | Waltz | 229/114 |
| 1,515,983 | 11/1924 | Williams | 229/195 |
| 1,680,661 | 8/1928 | Birrell | 229/197 |
| 2,488,703 | 11/1949 | Buttery | 229/114 |
| 3,059,829 | 10/1962 | Thompson | 229/195 |
| 3,481,525 | 12/1969 | Pierce, Jr. | 229/195 |

FOREIGN PATENT DOCUMENTS

| | | | |
|---|---|---|---|
| 1163521 | 9/1969 | United Kingdom | 229/195 |

*Primary Examiner*—Gary E. Elkins

*Attorney, Agent, or Firm*—Michael J. Doyle; Walt Thomas Zielinski

[57] ABSTRACT

A paperboard tray and unitary blank for forming it. Two of the tray blanks may be joined in tandem to form, after erection, a clamshell type carton. The tray is provided with cooperating latching tongues and latching slits to maintain it erected. The specific form of the latching tongues and slits enables the tray sides to tilt outwardly after initial tongue and slit engagement and thus permit stacking. The use of the tongue and slit of this invention also permits tray formation without the need of adhesives, thus permitting safe use of the tray or clamshell carton in serving food, as at the retail level.

7 Claims, 2 Drawing Sheets

LOCK SET TRAY

BACKGROUND OF THE INVENTION

This invention relates to the container art, and more particularly a paperboard tray formed from a unitary blank of stiff, resilient and foldable sheet material such as paperboard. In forming paperboard trays, whether their sides and edges are vertical or are slanted either inwardly or outwardly, it has been customary in the art to use an adhesive to join the end panels of the tray to the tray side panels. Typically, either the side panels, or the end panels, or sometimes both, will have extensions termed web panels which overlap with the end of a neighboring panel, with these overlapping portions being glued together to make the tray rigid and maintain it erected.

While such constructions are usually satisfactory, there are certain instances wherein the use of an adhesive is undesirable, such as when the tray is used to serve a food product. In such situations, it would be desireable to effect some other means of locking the ends of the side and end panels together to thereby maintain the tray in an erected or set up configuration and thereby impart the desired rigidity to it. The possibility of contamination of food by the adhesive usually exists no matter how slight and accordingly not all of the known tray constructions are suitable for a food use.

SUMMARY OF THE INVENTION

According to the practice of this invention, a tray blank is provided which will permit a paperboard tray to be formed, i.e., erected, without the use of adhesive. This is effected by the provision of a novel latching tongue and latching slit arrangement wherein, upon erection of the tray, the latching tongues enter corresponding latching slits and thus become engaged therein to maintain the side and end panels of the tray in an upright position.

This construction is particularly desireable in instances where the tray is to be used in a food environment, such as a fast food outlet wherein hamburgers or the like are served on trays. The specific locking tongue and locking slit arrangement of this invention permits the side walls of the tray to move from a substantially vertical to a slanted position after tongue engagement with the slits, to thereby provide a tray having sloping sides and thus permitting stacking of the trays.

The practice of this invention also permits the formation of a tray from a unitary paperboard blank, wherein the tray sides can be tilted outwardly after latching tongue and latching slit engagement, thereby permitting stacking of the trays.

DETAILED DESCRIPTION OF THE INVENTION

Figure 1:
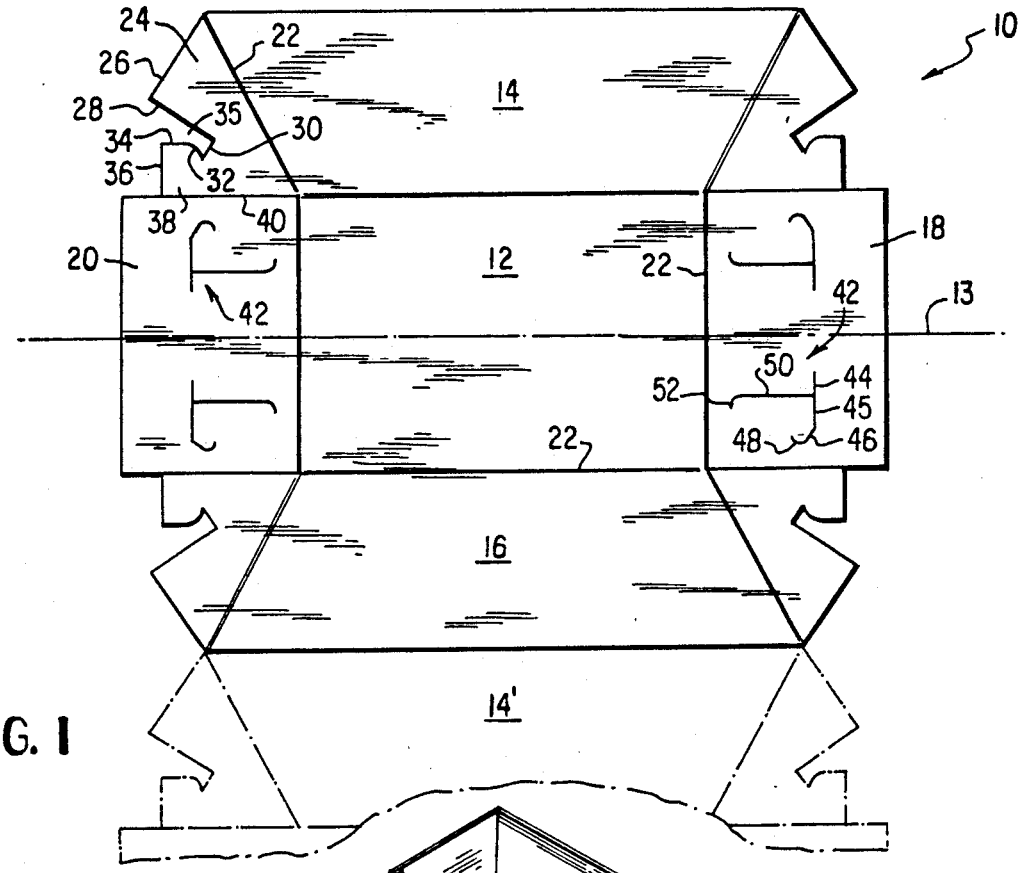
FIG. 1 is a plan view of a unitary paperboard blank provided with the locking tongue and locking slit configuration of this invention.

Referring now to FIG. 1 of the drawings, the numeral 10 denotes generally a unitary blank formed from still, resilient and foldable sheet material, such as paperboard. The blank has a central, bottom forming portion 12, with this bottom portion, together with the remaining portions of the blank, exhibiting mirror symmetry about central longitudinal axis 13. An upper side forming panel is denoted as 14, with a lower side forming panel denoted as 16. A right end panel is referenced 18, while 20 denotes a left end panel. It will be observed that the right and left halves of the blank also exhibit mirror symmetry about a (not illustrated) vertical mirror access of symmetry. The side and end panels are foldably secured to bottom panel 12 by means of conventional score lines 22.

Four web panels 24 are each integrally connected to a respective end of a respective side panel through a score line 22. The numeral 26 denotes an outer or free edge of web panel 24, with edge 26 being intersected at a right angle by edge 28. Edge 28 continues toward bottom panel 12 and terminates at short cut portion 30. This portion, in turn, is met by one end of an arcuate portion 32, of approximately 90 degrees angular extent, with the other end of this arcuate portion terminating in straight section 34. Section 36 intersects Section 34 at approximately 90 degrees. Edges 28, 30, 32 and 34 define a notch 35. Latching tongue 38 is positioned between notch 35 and cut line 40, the latter separating web panel 24 from end panel 20.

Each of the other three web panels is of identical construction to panel 24 and hence no description of these other web panels is required.

The numeral 42 denotes any one of two generally T-shaped latching slits in each of end panels 18 and 20. The upper leg of each T-shaped slit 42 includes an upper half straight portion 44, a lower half straight portion 45, with the latter portion 45 terminating in a slanted portion 46, with portion terminating at its end in an arcuate portion 48 curving toward base 50 of each T-shaped slit and of about 120 degrees angular extent. Each upper leg of T-shaped slits 42 extends vertically in FIG. 1 instead of in the usual horizontal orientation.

The base leg of the T (as viewed in the normal, vertical position of a T instead of the tilted 90 degree position shown) is defined by a main portion 50, the latter terminating in an arcuate portion 52 of approximately 90 degrees angular extent. The base 50 extends generally parallel to the upper and lower sides 22 of central panel 12.

Figure 2:
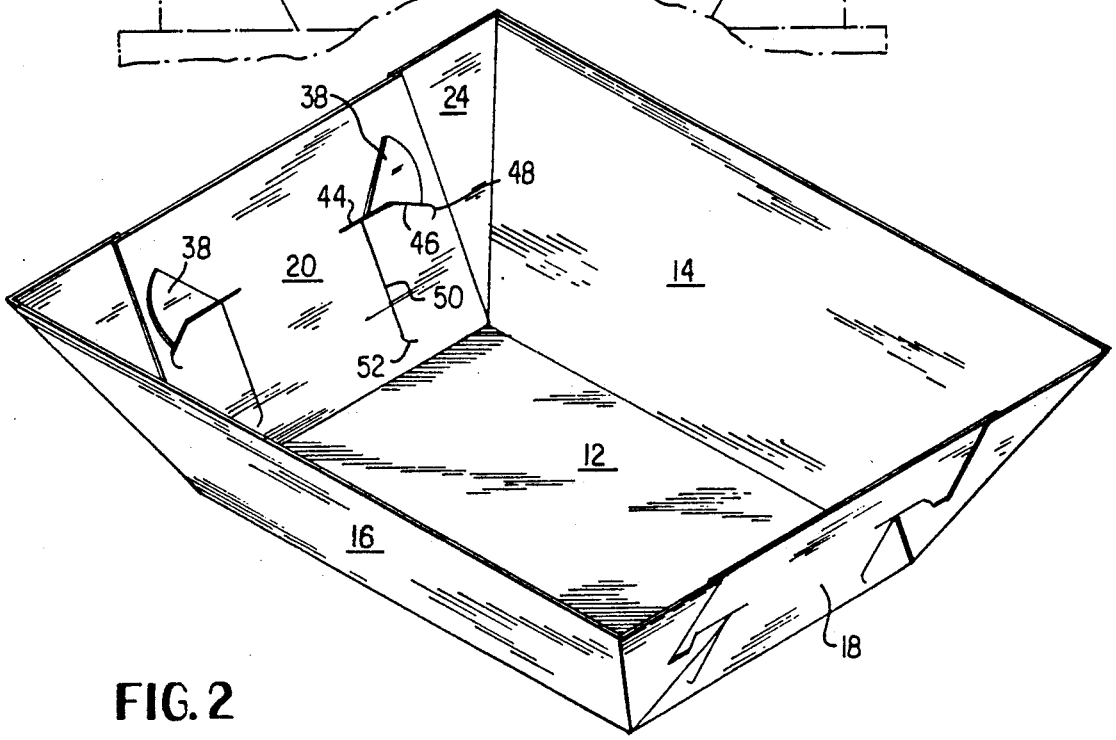
FIG. 2 is a perspective view of a tray formed from the blank of FIG. 1.

Referring now to FIG. 2 of the drawings, a tray erected or set up from the blank of FIG. 1 is illustrated. It will be seen that the sides of the tray slant upwardly and outwardly from bottom panel 12. To erect the tray, latching tongues 38 are inserted from the outside of their respective end panels into the latching slits 42. Tongue 38 is shown at FIG. 2 as extending through portions 45 and 46 of latching slits 42. Slanted portion 46 permits the movement of side panels 14 and 16 laterally outwardly after initial engagement of the latching tongue in the latching slits. This movement permits the tray to be erected with the sides 14 and 16, as well as ends 18 and 20, in a vertical position, with subsequent outward, slanting movement of both the sides and the ends due to the sliding action permitted by the novel shape of the latching slits 42 and cuts in webs 24.

Figure 3:
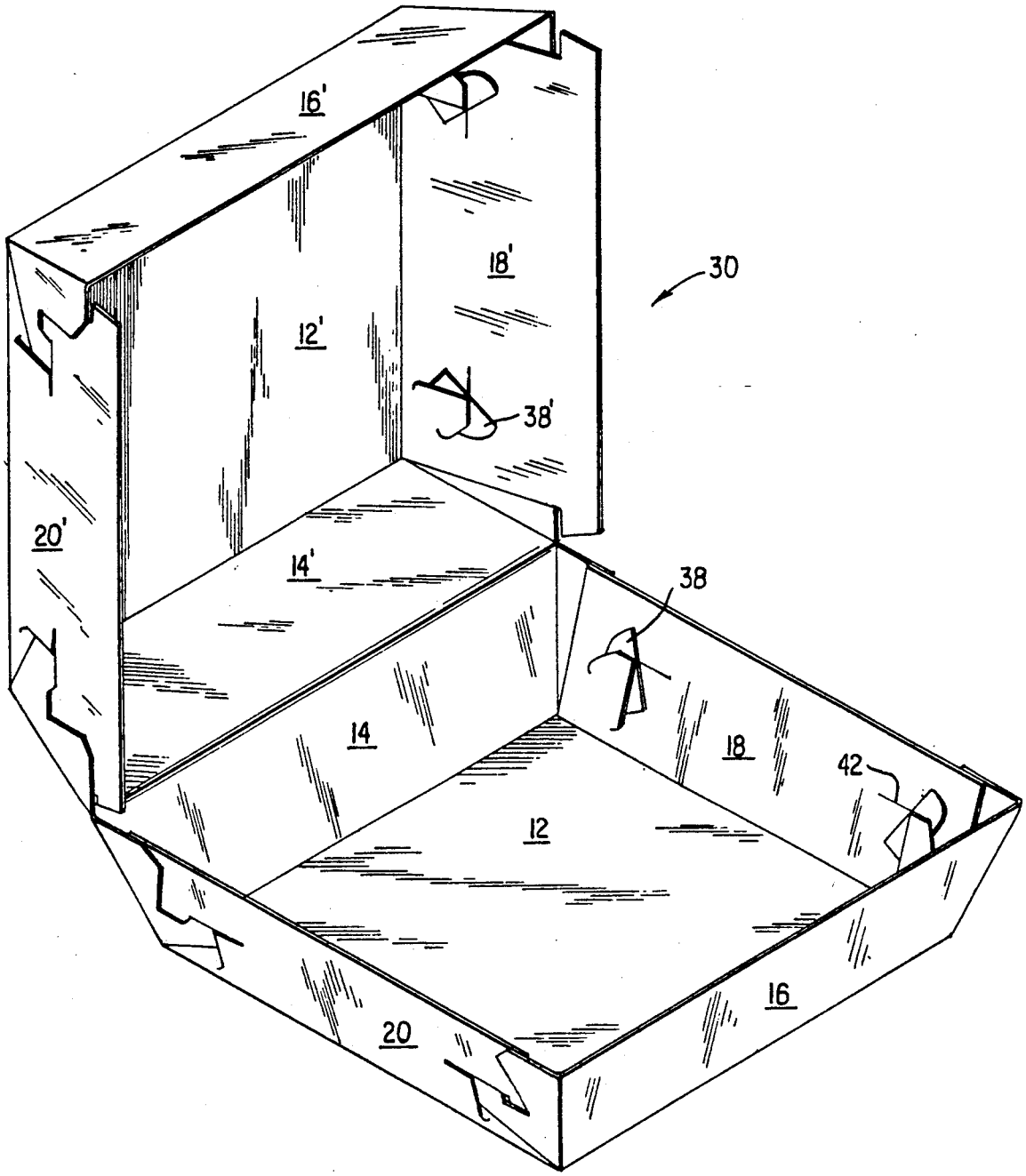
FIG. 3 is a perspective view of a clamshell type carton formed from a blank having a double or twin configuration of that shown in FIG. 1.

Referring now to FIG. 3 of the drawings, 30 denotes generally a clamshell type carton formed from a double blank (two twin blanks) obtained when two of the blanks shown at FIG. 1 are integrally joined in tandem along either the upper free edge of upper side panel 14 or the lower free edge of lower side panel 16. The term free edge means an edge not connected to any other panel, such as the upper edge of panel 14 or the lower edge of panel 16, as shown in FIG. 1. The dashed liens at the bottom edge of lower panel 16 indicate such a joining of two blanks, with 14' denoting the upper side panel of a twin blank, similar to upper side panel 14 of blank 10. Such tandem joining of blanks is similar to that shown in U.S. Pat. No. 2,214,525 issued to Murguiondo.

The latching tongue and latching slit construction of clamshell carton 30 is identical to that of FIGS. 1 and 2. Corresponding reference numerals are used in FIG. 3, a prime (') being placed after those numerals previously described in connection with FIGS. 1 and 2. It will be seen that there is a correspondence of elements, except that side panels 18' and 20' of the upper half of the clamshell are somewhat (optionally) elongated in vertical dimension (when the clamshell is closed). The two halves of carton 30 may, however, be completely identical. Further, the latching slits 42 have been described as being carried by the end panels 18 and 20, with complimentary latching tongues carried by web panels 24. The location of the slits and latching tongues may be reversed, if desired, so that end panels 18 and 20 carry the latching tongues, while webs 24 carry the latching tongues.

Paperboard tray or tray like constructions employing a latching tongue and a T-shaped latching slit, to effect erection of a tray or a carton from a blank, are known. U.S. Pat. Nos. 1,680,661 issued to Birrell and 2,325,775 issued to Eggebrecht utilize such a latching arrangement. However, neither locking slit of these two patented constructions permits the latching tongue to slide within 15 and relative to the T-slit after engagement therein, and thus permit a panel which carries the locking tongues to tilt relative to a panel carrying the slits.

The terms vertical, horizontal, upper, lower, and the like are intended to be terms of geometrical orientation to assist the reader to an understanding and are not intended as terms of limitation.

I claim:

1. A paperboard blank for forming a tray, the blank defining a plane, the blank having a central, rectangular bottom forming panel, upper and lower side forming panels each having ends and foldably connected to respective upper and lower sides of the central panel, left and right end forming panels foldably connected to respective left and right ends of the central panel, ends of the side forming panels each carrying a latching tongue, each end panel provided with a pair of generally T-shaped latching slits with the base of each T-shaped slit being horizontal and generally parallel to said upper and lower sides of the central panel whereby each latching tongue can be inserted into a respective latching slit upon the upward bending of the side and end panels form the plane of the central panel and each tongue can slide in its respective latching T-shaped latching slit after insertion therein, each end of the side forming panels provided with a foldable web panel, each web panel carrying a respective one of said latching tongues, and wherein the foldable connection between each web panel and its respective side panel is at an angle to the left and right ends of the central panel, so that each side panel becomes wider with increasing distance from the central panel.

2. The blank of claim 1 wherein one leg half portion of each T upper leg is defined by a straight portion terminating at a slanted portion, the latter terminating at an arcuate portion, the latter curving toward the base of the respective T-shaped slit.

3. The blank of claim 1 wherein the latching tongue has a convexly curved portion.

4. A blank for forming a clamshell type tray, the blank defined by two of the blanks as defined in claim 1 which are joined, in tandem, along free edges of their side panels.

5. A tray formed from a unitary blank of paperboard, the tray having a central, generally rectangular bottom panel, a pair of outwardly slanted side panels, each side panel having an end and a pair of outwardly slanted end panels, the end of each side panel having a latching tongue, each end panel having a pair of generally T-shaped latching slits, each latching tongue being engaged in a respective latching slit, each latching tongue being slidable when engaged so as to permit the side panels to slant outwardly from a vertical to a slanted orientation.

6. The tray of claim 5 wherein each side panel end is foldably jointed to a web panel, each web panel carrying a said latching tongue.

7. A clamshell type carton defined by two of the trays as defined in claim 6 which are joined, in tandem, along free edges of their side panels.

* * * * *